US005668091A

United States Patent [19]

Grinham et al.

[11] Patent Number: 5,668,091

[45] Date of Patent: Sep. 16, 1997

[54] LUBRICANT FOR LUBRICATING A TIRE FOR ROTARY TRUNNION SUPPORTED EQUIPMENT

[75] Inventors: Terry Grinham; Marc Salvador, both of North Lancaster, Canada

[73] Assignee: Christina Grinham, Quebec, Canada

[21] Appl. No.: 244,152

[22] PCT Filed: Feb. 21, 1994

[86] PCT No.: PCT/CA94/00091

§ 371 Date: Nov. 11, 1995

§ 102(e) Date: Nov. 11, 1995

[87] PCT Pub. No.: WO94/26851

PCT Pub. Date: Nov. 24, 1994

[30] Foreign Application Priority Data

May 11, 1993 [CA] Canada ..... 2095996

[51] Int. Cl.[6] ..... C10M 103/02; C10M 111/00

[52] U.S. Cl. ..... 508/123; 508/105; 508/109; 508/113; 508/131

[58] Field of Search ..... 508/123, 105

[56] References Cited

U.S. PATENT DOCUMENTS

| | | | |
|---|---|---|---|
| 787,752 | 4/1905 | Griffen | 508/105 |
| 3,629,107 | 12/1971 | Groszek et al. | 508/123 |
| 3,928,214 | 12/1975 | Naka et al. | 508/123 |
| 4,050,932 | 9/1977 | Lemmer | 508/123 |
| 4,363,737 | 12/1982 | Rodriguez | 508/123 |
| 4,915,856 | 4/1990 | Jamison | 508/105 |
| 5,415,791 | 5/1995 | Chou et al. | 508/105 |
| 5,498,351 | 3/1996 | Hefling | 508/123 |

FOREIGN PATENT DOCUMENTS

| | | |
|---|---|---|
| 308759 | 3/1989 | European Pat. Off. . |
| 479516 | 4/1992 | European Pat. Off. . |
| 538815 | 4/1993 | European Pat. Off. . |
| 1381315 | 3/1988 | U.S.S.R. . |
| 94-26851 | 11/1994 | WIPO . |

OTHER PUBLICATIONS

Search Report, PCT/CA94/00091; WO 94/26851, Grinham (Nov. 1994).

Preliminary Examination Report, PCT/CA94/00091; now WO94/26851, Grinham (Nov. 1994).

*Primary Examiner*—Ellen M. McAvoy

*Attorney, Agent, or Firm*—Bacon & Thomas

[57] ABSTRACT

A lubrication block, with or without a cavity, or a lubrication bag, for lubricating an ID surface of a tire and an OD surface of a plurality of pads of rotary trunnion supported equipment, such as a kiln, cooler, dryer, reactor, granulator and ball mill operating at temperatures from 100° F. to 500° F. or higher. The tire has inner and outer faces, and the inner face of the tire is slipped over the plurality of pads or filler bars welded to an outer shell of the rotary equipment. The lubrication block or bag is sized so as to be inserted in between the pads. The lubrication block comprises a lubricant and a solid carrier for said lubricant. The carrier is selected from the group consisting of waxes such as paraffin, polymers, copolymers such as ethylene or polyethylene glycol or mixtures thereof, and the lubricant comprises powdered carbon and a soft metal powder (e.g. copper, zinc, aluminum) or a noble metal powder (e.g. silver, copper).

18 Claims, 2 Drawing Sheets

LUBRICANT FOR LUBRICATING A TIRE FOR ROTARY TRUNNION SUPPORTED EQUIPMENT

FIELD OF THE INVENTION

This invention relates to a lubricant for use in lubricating an ID surface of a tire and an OD surface of a plurality of pads of rotary trunnion supported equipment, such as a kiln, cooler, dryer, reactor, granulator and ball mill.

BACKGROUND OF THE INVENTION

The rotary kiln is a cylindrical shell driven by a bull gear. There is a plurality of pads welded to the shell and these pads are approximately four inches thick by four inches wide. The pads each have an OD surface. There is also a tire having an inner face (ID surface) and the inner face is slipped onto the plurality of pads. The tire is supported by a plurality of trunnion supported rollers.

So as to allow for expansion and other movement between the tire and the pads, the OD surface of the pads is smaller than the ID surface of the tire. In other words, there are two dimensions; a large one being the tire and a smaller one being the kiln shell and pads. Because, there are two different dimensions, there is creep or slippage between the tire and the pads. If there is any friction between the ID surface of the tire and the OD surface of the pads, due to inadequate lubrication of these surfaces, the creep or slippage can increase and can cause many problems in the maintenance of the kiln. Therefore, it is necessary to lubricate the ID surface of the tire and the OD surface of the pads. The pads are separated by approximately four inches allowing a lubricant to lubricate the ID surface of the tire and the OD surface of the pads.

The combination of a polymer carrier containing antioxidants which prevent the metal of the shell from oxidising at a high temperature, thickening agents, powdered carbons and at least one soft metal namely (e.g. copper, zinc, aluminum), in order to produce a lubricating formula in liquid suspension is already well known and commonly used for lubricating, an ID surface of a tire and an OD surface of a plurality of pads, operating at temperatures from 100° F. to 500° F. or higher.

Hitherto, it has been common to have the carrier and the lubricant in a liquid or semi-liquid suspension. When the combination is in liquid suspension, it is applied to the inner surface of the tire by using hoses, pumps and a large keg that contains the liquid or semi-liquid suspension. The carrier evaporates at the temperature of the tire and releases a dry lubricant, leaving very little harmful residue on the tire.

The problem with using hoses, pumps and a keg to apply the lubricant in liquid suspension to the tire, is that it is a messy and elaborate job that takes some time to complete. Other problems that arise when using a liquid or semi-liquid lubricant is the distribution of pressurized air or electricity from pier to pier to operate the pump that is required to apply the lubricant to the ID surface of the tire and also the manoeuvring of the keg or drum from pier to pier on a grated catwalk spanning up to 700 feet in length. In many cases, there is no catwalk connecting the piers, so therefore the keg or drum must be hoisted approximately 32 feet in the air to reach the tire for lubrication.

It is also well known to provide a lubricant in the form of a solid graphite lubrication block, the block being inserted in between the pads, between the ID surface of the tire and the kiln shell. As the tire rotates with the kiln shell, the graphite block rubs against the high spots and the graphite coats the ID surface of the tire. But the graphite block often tu3nbles with the rotation of the tire, and therefore leaves an insufficient amount of graphite on the ID surface Of the tire Which then deposits the graphite on the OD surface of the pads, in order to prevent metal to metal contact. Therefore, the graphite block is an even less efficient lubricant than the liquid suspension. Furthermore, graphite in itself only becomes an efficient lubricant when it is on a machine like surface, where it may laminate, whereas both of the above mentioned surfaces are very porous and rough.

SUMMARY OF THE INVENTION

It has now been discovered and this is an object of the present invention, that the problem of using messy hoses, pumps and a large keg to apply the lubricant in liquid or semi-liquid suspension to the ID surface of the tire or the problem of distributing the powdered carbon (e.g. graphite uniformly, can be remedied by using, a simple method of lubrication namely a melting lubrication bar (M.L.B.) for lubricating an ID surface of a tire and an OD surface of a plurality of pads, offering even lubrication between the tire and the plurality of pads and operating at temperatures from 100° F. to 500° F. or higher. The lubrication bar is sized so as to be inserted in between the pads. The bar consists of a lubricant and a solid carrier for the lubricant.

The powdered lubricant may comprise powdered carbons (e.g. carbon black and graphite) as well as a soft metal powder and a noble metal powder. The particle size of the powdered lubricant is selected so as to lubricate appropriately the porous ID and OD surfaces.

The carrier may be selected from the group consisting of waxes such as paraffins which contain anti-oxidants; polymers, copolymers such as ethylene or polyethylene glycol or a mixture thereof and in some cases an inducer to help the carrier melt at a lower temperature. The carriers having such melting points as to melt and vaporize at the temperature of the tire, leaving very little harmful residue, and permitting the powdered metals of the lubricant, preferably composed of a noble metal and a soft metal, to fill the pores of the ID surface of the tire and the OD surface of the pads and allowing the graphite to laminate properly and uniformly on the surfaces, thus giving optimum lubrication value and heat dissipation.

According to a preferred embodiment of the invention, the carrier and the lubricant are intimately admixed with each other to form a solid lubrication bar or block.

According to another preferred embodiment of the invention, the lubrication block has at least one cavity which contains the lubricant. The carrier that surrounds the lubricant may also contains some of the lubricant.

According to a further preferred embodiment of the invention a lubrication box is also used for lubricating the ID surface of the tire and the OD surface of the plurality of pads, operating at temperatures from 100° F. to 500° F. or higher. The box is sized so as to be inserted in between the pads. The box has at least one cavity and contains the powdered lubricant mentioned hereinabove comprising of a noble metal and a soft metal having a specific average particle size. The box is made of a material that wears away over time due to friction, while the box tumbles on the tire and shell. The cavity is provided with holes that are-sized so as to allow the powdered lubricant particles to sprinkle out of the box and onto the tire as the box tumbles with the tire. Preferably, the box may be made of graphite.

The invention as claimed relates to a lubricant composition in the form of a bar for lubricating an ID surface of a tire and an OD surface of a plurality of pads of a trunnion supported rotary equipment. The tire operating at temperature equal to or higher than 100° F. The pads are welded to an outer shell of the rotary equipment and the bar is sized so as to be inserted in between the pads. Aocording to the invention the claimed bar is characterized in that the composition consists of a solid mixture of a solid lubricant powder with a solid carrier for the solid lubricant. The carrier is selected among carriers having such melting points as to melt and vaporize at said tire temperature, thereby releasing said lubricant while leaving very little harmful residue on said tire.

BRIEF DESCRIPTION OF THE DRAWINGS

The Figures illustrate non-limitating embodiments of the invention.

DESCRIPTION OF PREFERRED EMBODIMENTS OF THE INVENTION

Figure 1:
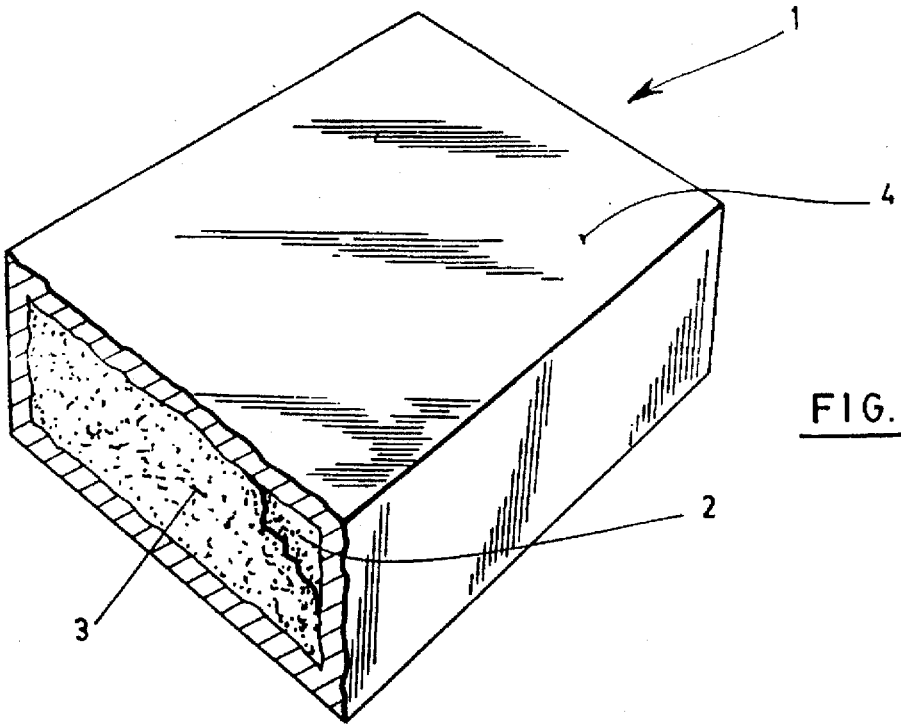
FIG. 1 is a cross-sectional perspective view of a lubrication block showing the powdered lubricant completely filling the cavity of the block.

The lubrication block 1 according to the invention as shown in FIG. 1 is used for lubricating an ID surface of a tire and an OD surface of a plurality of pads, operating at temperatures from 100° F. to 500° F. or higher. A rotary kiln comprises a large, refractory-lined cylinder that can be at least up to 700 to 800 feet long and up to 20 feet in diameter. The cylinder rotates slowly and is inclined up to 5° angle. The rotary kiln acts as a furnace in certain industries like magnesium, cement, clays, lime, gypsum, vermiculite and perlite, iron, gold, copper, silver, titanium, aluminum, soda ash, hydrofluoric acid, nitrogen, sand, potash, nickel, tungsten, zinc and bauxite. These various materials are fed into the rotary kiln by a feed inlet at an elevated end. The materials are fed into the rotary kiln at the elevated end, and are discharged at a lower end. The internal temperatures of the rotary kiln vary from one material to another and can reach as high as 3000° F.

The rotary kiln is a cylindrical shell, driven by a bull gear that has pads welded to the shell, these pads are approximately four inches thick by four inches wide, and a tire having an inner face, is slipped on to the pads and is supported by a plurality of trunnion support rollers. The pads are separated by a space of approximately four inches that allows a lubricant to lubricate the ID surface of the tire and the OD surface of the pads. So as to allow for expansion and other movement between the tire and the pads, the OD surface of the pads is smaller than the ID surface of the tire. In other words, there are two dimensions, a large one being the tire, and a small one being the outer surface of the kiln shell and pads. Because, there are two different dimensions, there is creep or slippage between the tire and the pads. If there is any friction between the ID surface of the tire and the OD surface of the pads, due to inadequate lubrication of these surfaces, the creep or slippage can increase and can cause many problems in the maintenance of the kiln. Therefore, it is necessary to lubricate the ID surface of the tire and the OD surface of the pads. So, the lubrication block 1 is sized so as to be inserted in between the pads on the ID surface of the tire.

As is shown in FIG. 1, the lubrication block 1 has at least one cavity 2 and comprises a lubricant 3 and a solid carrier 4 for said lubricant 3. The lubrication block 1 may have a plurality of small cavities 2 containing the lubricant 3, and the carrier 4 also contains some lubricant 3.

According to a preferred embodiment of the invention, the carrier 4 and the lubricant 3 are combined together to form a blended solid lubrication block, without the cavity 2 that is shown in FIG. 1.

The lubrication block 1, with or without the cavity 2 is applied manually between the pads. Once the lubrication block 1 is exposed to the temperature of the tire, the carrier 4 selected among carriers having a specific melting point, melts and releases the lubricant 3, leaving very little harmful residue on the tire.

The carrier 4 of the lubrication block 1 is selected from the group consisting of waxes containing anti-oxidants that prevent the metal of the kiln shell from oxidising at a high temperature, polymers, copolymers or mixtures thereof. In the preferred embodiment, the wax is a paraffin having a melting point of 125° F. to 127° F. namely paraffin wax No. 1230 by International Waxes Ltd. The copolymer is an ethylene acrylic acid copolymer having a melting point of 103° C. to 110° C. namely Ethylene copolymer EAS-1 by BASF or an ethylene-vinyl.acetate copolymer consisting predominantly of polyethylene having a melting point of 87° C. to 92° C. namely Polyethylene glycol EVA-1 also by BASF. The advantage of using paraffin as the carrier, over a copolymer or a polymer is that paraffin melts leaving very little harmful residue behind, whereas the polymers or copolymers may leave a fair amount of plastic residue behind after they have melted and vaporized.

The lubricant 3 of the lubrication block 1 comprises powdered carbon and at least one soft metal powder or at least one noble metal powder. In the preferred embodiment, the powdered carbon is a mixture of natural graphite namely graphite No. 146 by Asbury Wilkinson and carbon black namely carbon black No. 5305 by Asbury Wilkinson.

In the preferred embodiment, the soft metal powder is selected from the group consisting of copper, zinc, aluminum or a mixture thereof. The copper is selected from copper powders having a maximum % retention on No. 325 mesh of 1.5% namely Copper Flake Powder No. 530 by Canbro. The zinc is selected from zinc dusts having an average particle size of 3.50–4.50 microns namely Zinc Dust UP4 by Purity Zinc. The aluminum is selected from aluminum powders having a maximum % retention on No. 325 mesh of 1.5% namely Aluminum Powder No. 805 by Canbro. The advantage of using copper powder is that it is the second most economical metal lubricant powder and it dissipates heat quite effectively.

In the preferred embodiment, the noble metal powder is selected from the group consisting of copper, silver or a mixture thereof. The copper is selected from copper powders having a maximum % retention on No. 325 mesh of 1.5% namely Copper Flake Powder No. 530 by Canbro. The silver is selected from silver powders having a maximum % retention on No. 325 mesh of 1.5% namely silver powder by Johnson and Matthey. The advantage of using copper powder is already mentioned hereinabove, but silver powder dissipates heat even more than copper powder.

This lubrication block 1 can also be used in the same manner for lubricating the tires of a dryer, operating at a temperature lower than that of a rotary kiln. Most dryers radiate heat onto the ID surface of the tire, of approximately 100° F. and the carrier 4, for instance paraffin does not melt at temperatures under 125° F. As shown in the example hereinafter, an inducer is also used in the lubrication block 1, that melts at a lower temperature in order to allow the carrier 4 to start melting at a temperature that is below the melting point of the carrier 4. In this invention, the inducer is an aliphatic carboxylic acid having a melting point of 32° C. maximum, namely Emery 882, mixed coconut fatty acid by St-Lawrence Chemicals. The inducer can also be paradichlorobenzene having a melting point of 52.5° C. by Recochem. However, this compound releases a foul odor, therefore Emery 882 is preferred as the inducer.

Figure 2:
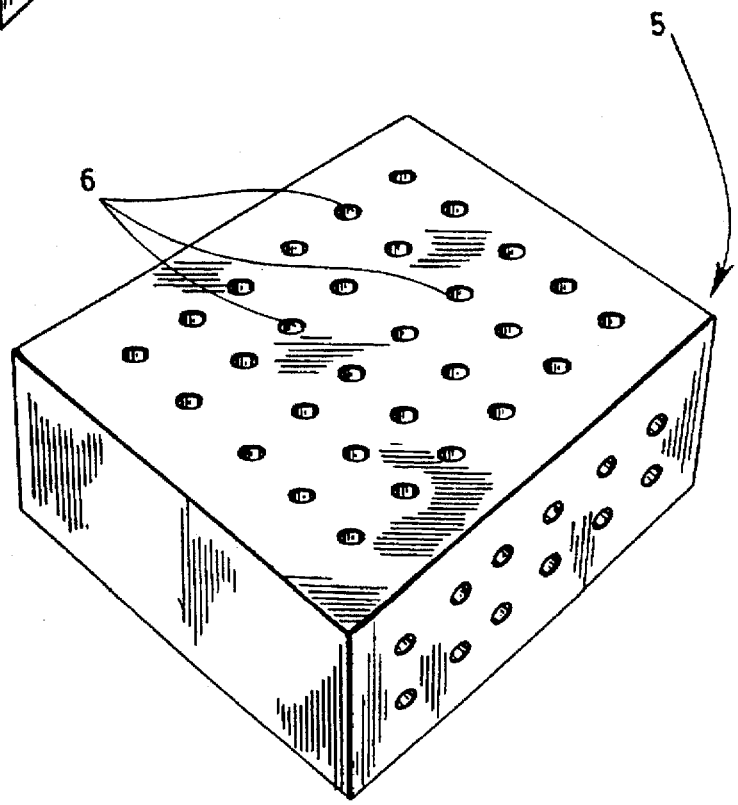
FIG. 2 is a perspective view of a lubrication box according to the invention showing the surfaces of the lubrication box provided with holes.

As shown in FIG. 2, a lubrication box 5 according to the invention can also be used for lubricating the ID surface of the tire and the OD surface of the plurality of pads, operating at temperatures from 100° F. to 500° F. or higher. The box 5 is sized so as to be inserted in between the pads. The box 5 can be cylindrical or square. The box 5 has at least one cavity 2 and contains the powdered lubricant 3 mentioned hereinabove comprising of a soft metal and a noble metal having a specific average particle size. The box 5 is made of a material that wears away over time due to friction while tumbling on the inner surface of the tire. The cavity 2 is provided with holes 6 sized so as to allow the powdered lubricant particles 3 to sprinkle out of the lubrication box 5 and onto the inner surface of the tire, when the lubrication box 5 tumbles with the tire. Preferably, the box may be made of graphite namely graphite No. 146 by Asbury Wilkinson.

Figure 3:
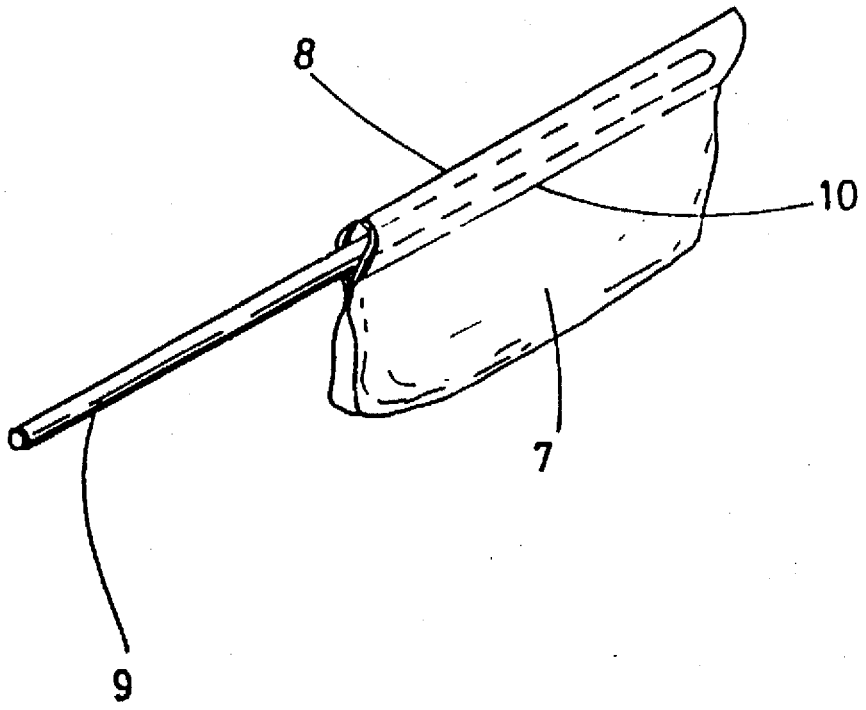
FIG. 3 is a perspective view of a lubrication bag according to the invention, showing a stick being received by the longitudinal loop on the top surface of the bag.

As shown in FIG. 3, a lubrication bag 7 can also be used for lubricating the ID surface of the tire and the OD surface of the plurality of pads, operating at temperatures from 100° F. to 500° F. or higher. The lubrication bag 7 contains the lubricant 3 mentioned hereinabove, which also preferably contains paraffin in chip form. The bag 7 is made of a material selected among materials having such melting points as to melt and vaporize at the temperature of the tire releasing the lubricant 3, leaving very little harmful residue on the tire. The material is selected from the group consisting of plastic material such as polymers, copolymers, namely polybutene, ethylene or polyethylene glycol, or mixtures thereof. The copolymer is an ethylene acrylic acid copolymer having a melting point of 103° C. to 110° C. namely Ethylene copolymer EAS-1 by BASF, or an ethylene-vinyl acetate copolymer consisting predominantly of polyethylene having a melting point of 87° C. to 92° C. namely Polyethylene glycol EVA-1 also by BASF, or polybutene vaporizing at a temperature of 300° F. by Amoco.

The bag 7 also includes means 8 for engaging a support stick 9. The bag 7 has a top surface 10 provided with a longitudinal loop 8 sized so as to receive the stick 9. There can also be small individual loops of material receiving the stick 9. The stick 9 supports the bag 7 and applies the bag 7 onto the tire.

The following examples are used to illustrate preferred embodiments of the invention and it should be pointed out that any modification to this preferred embodiment, within the scope of the appended claims, is not deemed to change or alter the nature of the invention.

EXAMPLE I

A lubrication block without a cavity, for lubricating an ID surface of a tire and an OD surface of a plurality of pads, of a rotary kiln operating at temperatures from 100° F. to 500° F. or higher, is made by first melting the carrier and then mixing the carrier and the powdered lubricant together in a heated sheering blender, pouring the mixture into molds, letting the mixture solidify in the molds and cutting the molded blocks into bars. The advantage of using the paraffin as a carrier is that paraffin melts and leaves behind very little harmful residues, whereas the plastic materials may leave a fair amount of residue behind. The advantage of using copper powder is that it is the second most economical metal lubricant powder and it dissipates heat quite effectively. The ingredients are:

| | Ingredient | % Weight |
|---|---|---|
| Carrier: | Paraffin | 59.4 |
| Lubricant: | Graphite | 9.0 |
| | Copper Powder | 4.4 |
| | Zinc dust | 6.2 |
| | Carbon black | 21.0 |

EXAMPLE II

A lubrication block without a cavity, for lubricating an ID surface of a tire and an OD surface of a plurality of pads, of a dryer operating at a temperature of 100° F., is made by first melting the carrier and then mixing the carrier, inducer and powdered lubricant together in a heated sheering blender, pouring the mixture into molds, letting the mixture solidify in the molds and cutting the molded blocks into bars. The advantage of using an inducer is that the inducer melts at a lower temperature than other compounds in order to allow the carrier to start melting at a temperature that is below the melting point of the carrier. The advantage of using Emery 882 over paradichlorobenzene, is that the latter releases a foul odor when it is used. The advantage of using silver powder in this example is that it dissipates heat better than copper powder. The ingredients are:

| | Ingredient | % Weight |
|---|---|---|
| Carrier: | Paraffin | 25.3 |
| Inducer: | Emery 882 | 27.4 |
| Lubricant: | Graphite | 9.0 |
| | Copper Powder | 0.8 |
| | Zinc Dust | 3.1 |
| | Carbon black | 33.4 |
| | Silver | 1.0 |

EXAMPLE III

A lubrication bag for lubricating an ID surface of a tire and an OD surface of a a plurality of pads, of a rotary kiln operating at temperatures from 100° F. to 500° F. or higher, is made by mixing the powdered lubricant and the paraffin chips together in a sheering blender and inserting the mixture into the bag (carrier) or inserting the paraffin chips and the powdered lubricant into the bag separately, and the bag is then applied on the ID surface of the tire and releases the chips and lubricant when it vaporizes. The bag however is made out of plastic material not wax. The ingredients are:

| | Ingredient | % Weight |
|---|---|---|
| Carrier: | Polybutene | 1.1 |
| | Ethylene copolymer | 1.1 |
| Lubricant: | Graphite | 9.0 |
| | Copper Powder | 0.8 |
| | Zinc Dust | 4.0 |
| | Carbon black | 66.4 |
| | Paraffin chips | 19.6 |

EXAMPLE IV

A lubrication box for lubricating an ID surface of a tire and an OD surface of a plurality of pads, of a rotary kiln operating at temperatures from 100° F. to 500° F. or higher, provided with holes sized to allow the following lubricating ingredients to sprinkle out of the lubrication box, when the lubrication box tumbles with the tire, is made by first making holes in the graphite box then inserting the powdered lubricant in the box, through the holes and then loosely inserting plugs in these holes so that the powdered lubricant does not sprinkle out before the box is applied to the kiln. But once the box tumbles on the tire of the kiln, the plugs are dislodged and the lubricant sprinkles out of the box. The ingredients are:

| | Graphite Box | | | |
|---|---|---|---|---|
| (microns) | 325 mesh | % Weight particle size | Average % retention No. | Maximum |
| Lubri- | Metal A: Copper | 45 | — | 1.5% |
| cant: | Metal B: Zinc | 55 | 3.5–4.5 | — |

EXAMPLE V

A lubrication block, without a cavity, for lubricating an ID surface of a tire and an OD surface of a plurality of pads, of a rotary kiln operating at temperatures from 100° F. to 500° F. or higher is made by first putting the Tixogel (clay) and Indopol H-25 (polybutene) into the molds and then having the Tixogel absorb the Indopol H-25. The Polywax 1000 is added and migrates to the sides of the molds, stiffening the clay after it migrates. The carrier is mixed with the powdered lubricant before the clay stiffens.

The advantage of using Tixogel VP. GS. (clay) with Indopol H-25 (polybutene) and Polywax 1000 is that Tixogel is hardened by Polywax 1000 without being flammable. The methanol activates the Tixogel. The ingredients are:

| | Ingredient | % Weight | Supplier |
|---|---|---|---|
| Carrier: | Indopol H-25 | 58.1% | Stanchem |
| | Tixogel VP. GS. | 15.3% | Henley |
| | Methanol | 0.4% | Stanchem |
| | Polywax 1000 | 18.4% | Petrolite |
| Lubricant: | Graphite #146 | 1.9% | Asbury Wilkinson |
| | Zinc Dust UP4 | 3.8% | Purity Zinc |
| | Copper Powder 530 | 2.1% | Canbro |

EXAMPLE VI

A lubrication block without a cavity, for lubricating an ID surface of a tire and an OD surface of a plurality of pads, of a dryer operating at a temperature of 100° F., is made by first melting the carrier and then mixing the carrier and powdered lubricant together in a heated sheering blender, pouring the mixture into molds, letting the mixture solidify in molds and cutting the molded blocks into bars. The ingredients are:

| | Ingredients | % Weight |
|---|---|---|
| Carrier: | Paraffin | 60.3% |
| Lubricant: | Graphite #146 | 25.4% |
| | Copper Powder 530 | 2.4% |
| | Zinc Dust UP4 | 11.9% |

We claim:

1. A method for lubricating trunnion supported rotary equipment comprising a shell on which are welded a plurality of pads each having an OD surface, and a tire slipped onto the pads, said tire having an ID surface adjacent said OD surfaces, said ID and OD surfaces being at a temperature of at least 100 ° F. when the equipment is operating, said method comprising the steps of:

providing a solid lubricant composition in the form of blocks sized to be inserted between the pads of the rotary equipment, said solid composition consisting essentially of a solid lubricant powder and a solid carrier for said solid lubricant, wherein said carrier melts and vaporizes at the temperature of said ID and OD surfaces when the equipment is operating; and inserting said blocks in between the pads, causing the lubricant to be released from the blocks as the carrier is melting, thereby ensuring continuous lubrication of the ID surface of the tire and the OD surfaces of the pads while leaving very little harmful residue.

2. A method according to claim 1, wherein the solid lubricant composition consists of an intimate mixture of said solid lubricant powder and said solid carrier.

3. A method according to claim 2, wherein said solid carrier is selected from the group consisting of waxes, polymers, copolymers and mixtures thereof.

4. A method according to claim 3, wherein said lubricant powder comprises powdered carbon and at least one powder of a metal selected amongst soft and noble metals.

5. A method according to claim 4, wherein said soft metal is selected from the group consisting of copper, zinc, aluminum and mixtures thereof.

6. A method according to claim 5, wherein said soft metal is copper having a maximum % retention on No. 325 mesh of 1.5%.

7. A method according to claim 5, wherein said soft metal is zinc having an average particles size of 3.50–4.50 microns.

8. A method according to claim 5, wherein said soft metal is aluminum having a maximum % retention on No. 325 mesh of 1.5%.

9. A method according to claim 4 wherein said noble metal is selected from the group consisting of copper, silver and mixtures thereof.

10. A method according to claim 9 wherein said noble metal is copper having a maximum % retention on No. 325 mesh of 1.5%.

11. A method according to claim 9, wherein said noble metal is silver having a maximum % retention on No. 325 mesh of 1.5%.

12. A method according to claim 4, wherein said powdered carbon includes graphite.

13. A method according to claim 2, wherein said intimate mixture consists of:

about 59.4% by weight of paraffin as said carrier; and a mixture of about 9.0% by weight of graphite, about 4.4% by weight of copper powder, about 6.2% by weight of zinc dust and about 21.0% by weight of carbon black as said lubricant powder.

14. A method according to claim 2, wherein said intimate mixture consists of:

about 25.3% by weight of paraffin as said carrier;

about 27.4% by weight of an aliphatic carboxylic acid as a melt inducer for the carrier, and a mixture of about 9.0% by weight of graphite, about 0.18% by weight of copper powder, about 3.1% by weight of zinc dust, about 1.0% by weight of silver powder and about 33.4% by weight of carbon black as said lubricant powder.

15. A method according to claim 1, wherein said blocks are in the form of boxes made of said carrier wherein the boxes each contain at least one cavity filled with said lubricant powder.

16. A method according to claim 15, wherein the carrier forming said boxes also contains part of said lubricant powder.

17. A method according to claim 1, wherein the carrier is selected from the group consisting of waxes, copolymers, polymers and mixtures thereof.

18. A method according to claim 1, wherein the trunnion supported rotary equipment is selected from the group consisting of rotary kilns, coolers, dryers, reactors, granulators and ball mills.

* * * * *